US007509706B2

(12) United States Patent
Clarke

(10) Patent No.: US 7,509,706 B2
(45) Date of Patent: Mar. 31, 2009

(54) BATTERY-POWERED PORTABLE VACUUM

(76) Inventor: Derick Royston Clarke, 14 Tench Road, Lansdowne Park, Calne, Wiltshire (GB) SW119PW ( * ) Notice: Subject to any disclaimer, the term of this patent is extended or adjusted under 35 U.S.C. 154(b) by 414 days.

(21) Appl. No.: 11/370,548

(22) Filed: Mar. 8, 2006

(65) Prior Publication Data

US 2007/0209140 A1 Sep. 13, 2007

(51) Int. Cl.
*A47L 5/36* (2006.01)

(52) U.S. Cl. ..... 15/327.5; 15/327.6; 15/412; 15/DIG. 1

(58) Field of Classification Search ..... 15/327.5, 15/327.6, 412, DIG. 1; *A47L 5/36*
See application file for complete search history.

(56) References Cited

U.S. PATENT DOCUMENTS 4,748,712 A * 6/1988 DiGiovanni ..... 15/327.5
5,588,177 A * 12/1996 Eriksen ..... 15/327.5

* cited by examiner

*Primary Examiner*—David A Redding
(74) *Attorney, Agent, or Firm*—Raymond M. Galasso; David O. Simmons; Galasso & Associates, LP

(57) ABSTRACT

A vacuum cleaner comprises an elongated vacuum body, a battery-pack attached to the elongated vacuum body and shoulder straps attached directly to the elongated vacuum body and/or the battery-pack. The battery-pack is engaged with an exterior side face of the elongated vacuum body and is generally positioned between said shoulder straps such that the battery-pack engages a back of a person having each arm extending through a respective one of said shoulder straps.

16 Claims, 3 Drawing Sheets

BATTERY-POWERED PORTABLE VACUUM

FIELD OF THE DISCLOSURE

The disclosures made herein relate generally to vacuum cleaners and, more particularly, to battery-powered vacuum cleaners and portable vacuum cleaners.

BACKGROUND

Various configurations of vacuum cleaners are well known. Examples of specific applications for which vacuum cleaners are configured include, but are not limited to, general home cleaning, cleaning industrial/work sites and cleaning automobile interiors. The general premise of operation of a vacuum cleaner is that a vacuum created by the vacuum cleaner serves to lift debris, water, and the like into a collection container of the vacuum cleaner typically through a flexible hose.

Portability and versatility are two valuable and useful attributes of a vacuum cleaner. Portability enables a vacuum cleaner to be used at different physical locations (e.g., different rooms in a building, different buildings, etc). Versatility enables a vacuum to be operated in a manner that is entirely or somewhat specific to a given application. For example, a vacuum cleaner that includes different cleaning attachments can be used in any number of different cleaning applications (e.g., cleaning water from floors, cleaning dust and debris off floors, cleaning dust and debris from wall and ceiling mounted fixtures, etc). Together, portability and versatility add value to a vacuum cleaner in that it can be used for a wide array of applications at any number of different locations.

Therefore, a vacuum cleaner that provides for portability and versatility is desirable in many applications. For example, at a construction/work site, a considerable amount of debris is typically generated. Examples of such debris include pieces of paper and plastic, various forms of dust, wasted supplies and the like. Accordingly, it is desirable that a vacuum used in a construction/work site be configured for efficiently picking up such debris (i.e., a high suction capability and easy emptying of debris) and for being conveniently carried such that it is not on the floor being pulled through such debris. Furthermore, because electrical outlets at construction/work sites are often sparse or entirely not available, a vacuum with an on-board power supply (e.g., a rechargeable battery-pack) is desirable as it enhances portability.

SUMMARY OF THE DISCLOSURE

Embodiments of the present invention are directed to a vacuum cleaner that is wearable on the back of a user and that is battery-powered. In addition to being wearable on a user's back, a vacuum cleaner in accordance with the present invention includes wheels that enable it to be supported on a floor in a conventional manner. Due to being battery-powered and wearable on a user's back as well as having the capability of being supported on a floor in a conventional manner, such a vacuum cleaner in accordance with the present invention provide exceptional portability and versatility. In applications where there is limited or no access to electrical power and where the floor is extremely dirty or cluttered, a battery-powered vacuum cleaner that is wearable on the back of a user has specific and advantageous functionality.

To further enhance utility and functionality of a vacuum cleaner in accordance with the present invention, battery-pack placement for a vacuum cleaner in accordance with the present invention is preferably configured so as to reduce wearer fatigue due to weight associated with the battery-pack.

The battery-pack is one of the heaviest vacuum cleaner components and, thus, has a direct impact on the associated loading on a person wearing the vacuum cleaner. Accordingly, the battery-pack is preferably situated close to the wearer's back such that the battery-pack has a limited impact on causing fatigue to the wearer.

In one embodiment of the present invention, a vacuum cleaner comprises a vacuum body, a battery-pack attached to the vacuum body and spaced-apart shoulder straps attached directly to at least one of the vacuum body and the battery-pack. The battery-pack is generally positioned between the shoulder straps.

In another embodiment of the present invention, a vacuum cleaner comprises an elongated vacuum body, a battery-pack attached to the elongated vacuum body and shoulder straps attached directly to at least one of the elongated vacuum body and the battery-pack. The battery-pack is engaged with an exterior side face of the elongated vacuum body and is generally positioned between the shoulder straps such that the battery-pack engages a back of a person having each arm extending through a respective one of the shoulder straps.

In another embodiment of the present invention, a vacuum cleaner comprises an elongated vacuum body, shoulder-straps, a battery-pack and a plurality of wheels. The elongated vacuum body has opposing end faces. An air outlet is within a first one of the end faces and an air inlet is within a second one of the end faces. The shoulder straps are attached to the elongated vacuum body. A first end portion of each one of the shoulder straps is attached to the vacuum body adjacent the first one of the end faces of the vacuum body and a second end portion of each one of the shoulder straps is attached to the vacuum body adjacent the second one of the end faces of the vacuum body. The battery-pack is attached to the elongated vacuum body. The plurality of wheels are attached to the side face of the elongated vacuum body. The wheels are attached to the side face of the elongated vacuum body at a region of the side face generally opposite a region of the side face where the battery-pack is attached to the side face such that a longitudinal axis of the elongated vacuum body is located between all of the wheels and the battery pack.

Turning now to specific aspects of the present invention, in at least one embodiment, battery-pack retention straps are provided and each one of the battery-pack retention straps are engaged with the battery pack and extending at least partially around the vacuum body for securing the battery pack to the vacuum body.

In at least one embodiment of the present invention, the vacuum body has opposing end faces and has an air outlet within a first one of the end faces and air inlet within a second one of the end faces.

In at least one embodiment of the present invention, a first end portion of each one of the shoulder straps is attached to the vacuum body adjacent the first one of the end faces and a second end portion of each one of the shoulder straps is attached to the vacuum body adjacent the second one of the end faces.

In at least one embodiment of the present invention, a flexible hose has a first end thereof attached to the air inlet of the vacuum body, an extension tube is attached to a second end of the extension tube, the extension tube includes a plurality of segments and the segments are telescopingly adjustable with respect to each other.

In at least one embodiment of the present invention, the battery pack is generally positioned between the first and second end portions of the shoulder straps.

These and other objects, embodiments, advantages and/or distinctions of the present invention will become readily apparent upon further review of the following specification, associated drawings and appended claims.

DETAILED DESCRIPTION OF THE DRAWING FIGURES

FIGS. 1-4 show various aspects of a vacuum cleaner in accordance with the present invention, which is referred to herein as the vacuum cleaner 10. Various types of vacuum cleaners and debris collection approaches used in vacuum cleaners are well known. A skilled person will appreciate that the present invention is not unnecessarily limited to a specific type or configuration of vacuum cleaner. For example, in one embodiment, a vacuum cleaner in accordance with the present invention is preferably a bag-less vacuum cleaner that has a debris compartment that is removable or openable for enabling debris to be emptied from within the debris compartment.

Figure 1:
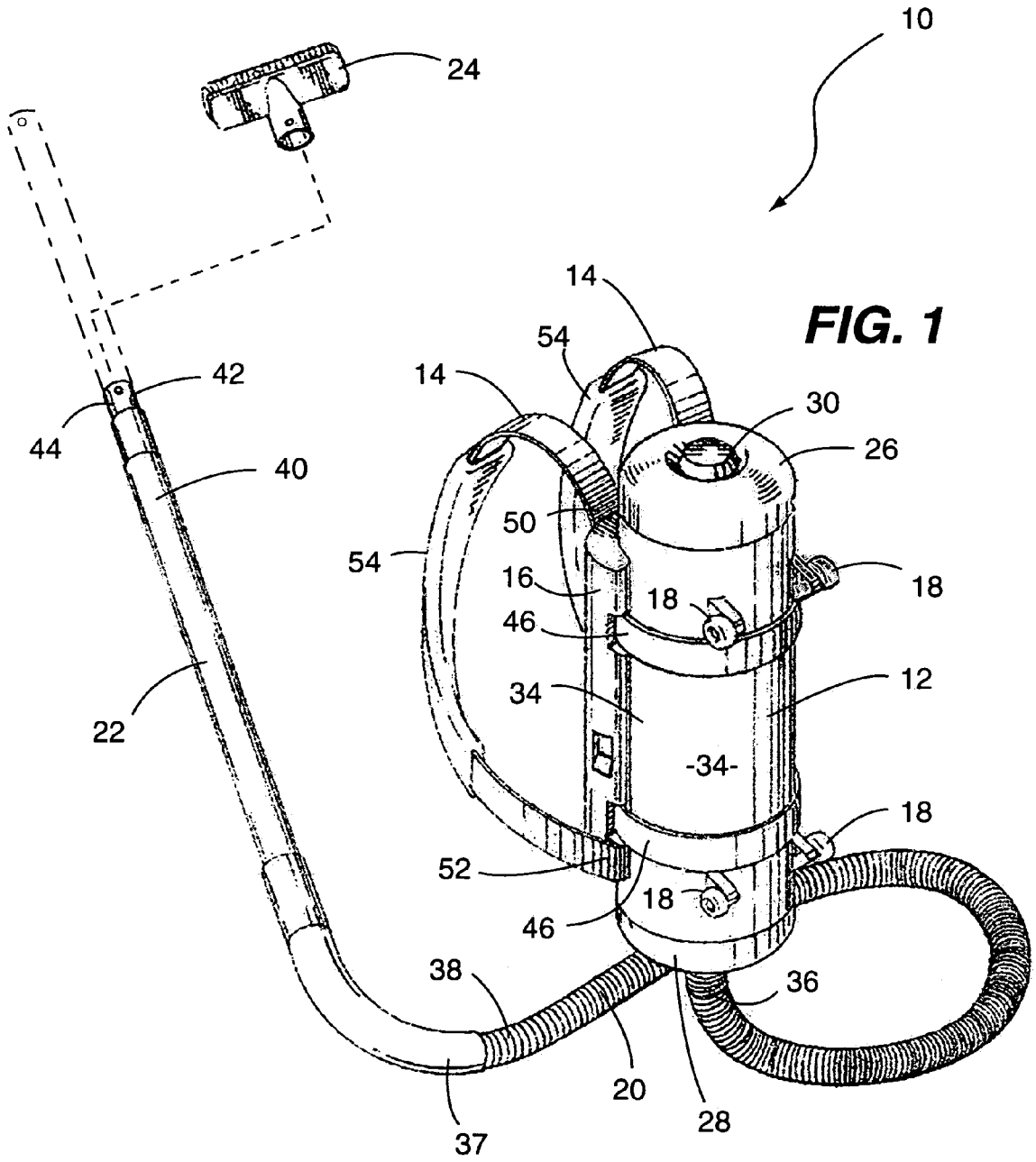
FIG. 1 is a perspective view showing a vacuum cleaner in accordance with the present invention.
Figure 2:
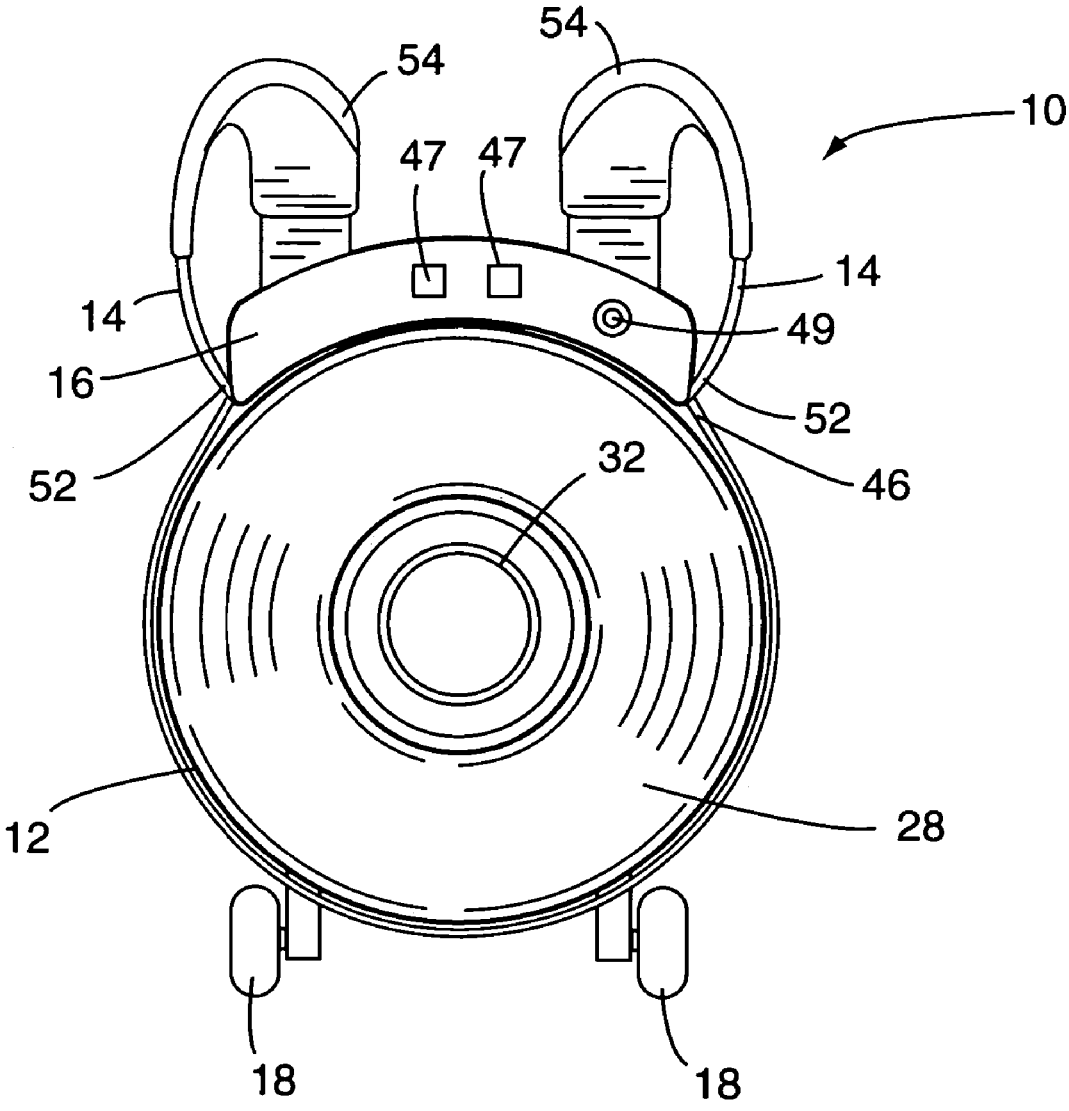
FIG. 2 is a top view of the vacuum cleaner of FIG. 1.

Now referring specifically to FIGS. 1 and 2, the vacuum cleaner 10 includes an elongated vacuum body 12, shoulder straps 14, a battery pack 16, wheels 18, a flexible suction hose 20, an extension tube 22 and a cleaning attachment 24. The vacuum body 12 has an upper end face 26 and a lower end face 28 generally opposing the upper end face 26. An air outlet 30 is within the upper end face 26 and an air inlet 32 is within the lower end face 28. Although the air outlet 30 and the air inlet 32 shown in FIGS. 1 and 2 as being within respective end faces (26, 28) of the vacuum body 12, the present invention is not unnecessarily limited to the air outlet 30 and the air inlet 32 being located within such respective end faces (26, 28). For example, the air inlet 32 may be in the upper end face 26 and the air outlet 30 may be in an exterior side face 34 (FIG. 1) of the vacuum body 12.

A skilled person will fully comprehend that vacuum generating components of the vacuum cleaner 10 are located within the vacuum body 12. For example, components such as a motor; vacuum impeller, debris compartment, etc are contained within the vacuum body 12. For example, a skilled person will appreciate that, in a bag-less embodiment of a vacuum cleaner in accordance with the present invention, debris is contained within a debris compartment of container within the vacuum body 12 and is emptied through a door in the vacuum body 12 or by removing the debris container from the vacuum body 12. As disclosed above, the present invention is not unnecessarily limited to a specific type or configuration of vacuum cleaner. Accordingly, the specific components contained within the vacuum body 12 and their specific integration are not discussed herein in specific detail.

A first end 36 of the suction hose 20 is attached to the air inlet 32 and a first end 37 of the extension tube 22 is attached to a second end 38 of the suction hose 20, thereby enabling extension and mobility of the extension tube 22. The extension tube 22 includes a first segment 40 and a second segment 42. The segments (40, 42) are telescopingly adjustable with respect to each other. Telescopingly is defined herein to include the second segment 42 of the extension tube 22 being mounted within the first segment 40 and the second segment 42 being able to slide longitudinally with respect to the first segment 40. Such telescoping functionality enables the extension tube 22 to be used for accessing location to be cleaned that are at varying distances of reach (e.g., levels of height).

The cleaning attachment 24 is attached to a second end 44 of the extension tube 22. In one embodiment, the cleaning attachment 24 is a brush attachment. In other embodiments, the cleaning attachment 24 is any one of a number of different configurations (e.g., floor sweeping head, water extraction head, tapered suction head, etc). The cleaning attachment 24 is not limited to any particular type of functional configuration.

Referring now to FIGS. 1-4, the battery-pack 16 is attached to an exterior side face 34 of the vacuum body 12. Battery-pack retention straps 46 are each engaged with battery-pack retention members 48 (FIGS. 3 and 4) of the battery pack 16. As depicted, the battery-pack retention straps 46 extend fully around the vacuum body 12 for securing the battery pack 16 to the vacuum body 12. In another embodiment (not shown), the battery-pack retention straps 46 extend only partially around the vacuum body 12 (e.g., are engaged with retention members of the vacuum body 12). Although not specifically shown, each one of the battery-pack retention straps 46 may be configured for being adjusted and/or quickly released (e.g., through a suitable buckle arrangement).

Figure 3:
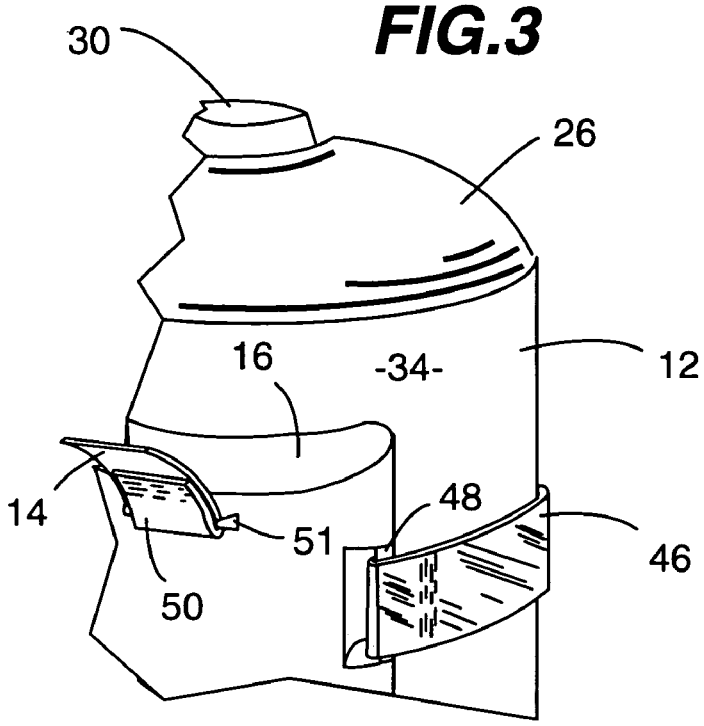
FIG. 3 is a fragmentary face view showing a top portion of a battery pack of the vacuum cleaner shown in FIG. 1.

Preferably, but not necessarily, the face of the battery-pack 16 that engages the exterior side face 34 of the vacuum body 12 is shaped such that it generally follows a shape of the engaged portion of the vacuum body 12. For example, as depicted in FIGS. 1-3, the exterior face 34 of the vacuum body 12 is generally cylindrical-shaped. Accordingly, the mating face of the battery-pack 16 has an inwardly curved profile.

In other embodiments of the present invention, the battery-pack retention straps 46 are omitted and the battery-pack 16 is secured to the vacuum body 12 using alternate means. Examples of such alternate means include, but are not limited to, mechanical fasteners (e.g., screws), mating interlocking structures, etc. Furthermore, it is contemplated that the battery-pack 16 may be integral with the vacuum body 12 (e.g., a housing of the battery pack 16 is integral with a housing of the vacuum body 12).

The battery-pack 16 supplies electrical power to other electrical components of the vacuum cleaner 10. For example, the battery-pack 16 supplies electrical power to a motor located within the vacuum body 12. Preferably, the battery-pack 16 is rechargeable. As shown in FIG. 2, the battery pack 16 includes contact terminals 47 through which a recharge voltage is applied through mating contact terminals of a cradle (not shown) on which the vacuum body 12 is stored. The battery pack 16 further includes a plug receptacle 49 through which the recharge voltage may be applied from a power cord of a recharge unit (i.e., a power cord of the cradle).

Still referring now to FIGS. 1-4, the shoulder straps 14 are attached directly to the battery-pack 16. An upper end portion 50 of each one of the shoulder straps 14 is attached to a respective upper shoulder strap retention member 51 of the battery pack 16. A lower end portion 52 of each one of the shoulder straps 14 is attached to a respective lower shoulder strap retention member 53 of the battery pack 16. The upper shoulder strap retention members 51 are spaced apart as are the lower shoulder strap retention members 53. Accordingly, the shoulder straps 14 are generally spaced apart. Preferably, but not necessarily, the shoulder straps 14 include padded portions 54 for enhancing comfort to a person wearing the vacuum cleaner 10.

Figure 4:
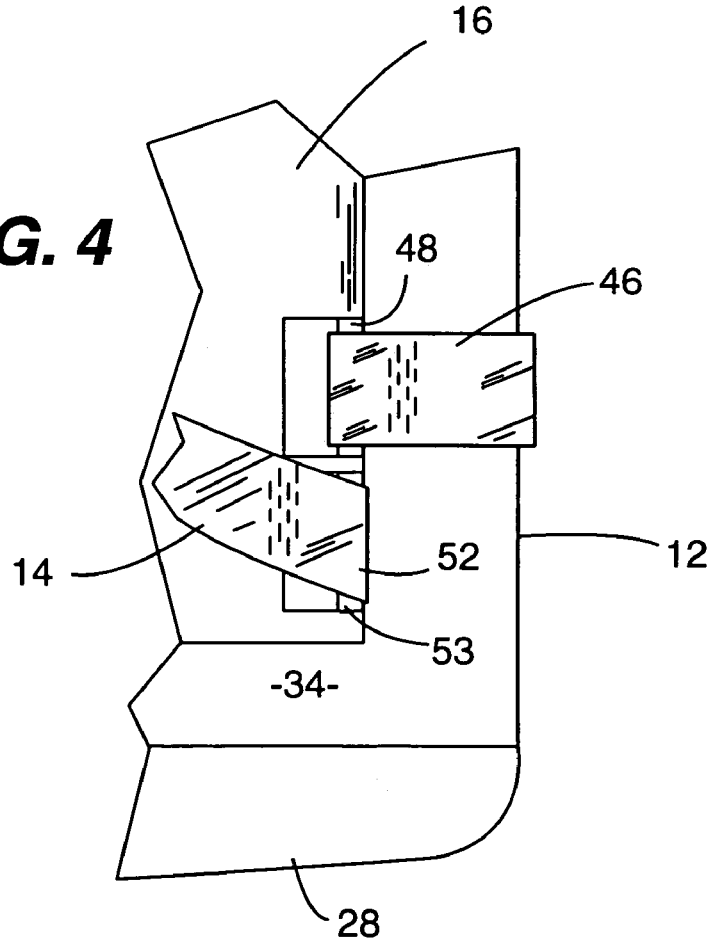
FIG. 4 is a fragmentary perspective view showing a bottom portion of the battery pack of the vacuum cleaner shown in FIG. 1.

In other embodiments of a vacuum cleaner in accordance with the present invention, the shoulder straps 14 are attached directly to the vacuum body 12 as opposed to the battery-pack 16. For example, in one such embodiment, the shoulder strap retention members (51, 53) shown in FIGS. 3 and 4, are integral with the vacuum body 12 as opposed to the battery pack 16. Such a configuration provides for the upper and lower portions (50, 52) of the shoulder straps 14 to be attached directly to the vacuum body 12 through the shoulder strap retention members (51, 53).

As shown in FIGS. 1-4, the battery-pack 16 is engaged with the exterior side face 34. Furthermore, the battery pack 16 is generally positioned between the spaced-apart shoulder straps 14 and, more specifically, between the upper and lower end portions (50, 52) of the shoulder straps 14. This battery-pack orientation provides for the battery-pack 16 to engage a back of a person having each arm extending through a respective one of the shoulder straps 14 (i.e., wearing the vacuum cleaner 10). Keeping the battery-pack 16 close to the back of a wearer of the vacuum cleaner 10 serves to positively impacts weight distribution associated with the battery-pack 16. As the battery-pack 16 is one of the heavier components of the vacuum cleaner 10, keeping its weight close to the back of the wearer reduces wearer fatigue associated with the weight of the battery.

The wheels 18 are attached to the exterior side face 34 of the vacuum body 12. The wheels 18 are attached to the exterior side face 34 of the vacuum body 12 at a first region of the exterior side face 34. The battery-pack is positioned at a second region of the exterior side face 34. The first region of the exterior side face 34 is generally opposite the second region of the exterior side face 34. More specifically, a longitudinal axis of the vacuum body 12 is located between all of the wheels 18 and the battery pack 14. The wheels enable the vacuum body 12 to be placed on a floor surface and moved in a conventional wheeled manner. With the vacuum body 12 in such a floor supported orientation, the battery-pack 14 is generally located on a respective top position of the vacuum body 12 with the wheels 18 being at a respective bottom position of the vacuum body 12.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A vacuum cleaner, comprising: a vacuum body; a battery-pack attached to the vacuum body; and spaced-apart shoulder straps attached directly to at least one of the vacuum body and the battery-pack, wherein the battery-pack is generally positioned between said shoulder straps, and further comprising: battery-pack retention straps each engaged with the battery pack and extending at least partially around the vacuum body for securing the battery pack to the vacuum body.

2. The vacuum cleaner of claim 1, wherein the vacuum body has opposing end faces and has an air outlet within a first one of said end faces and air inlet within a second one of said end faces; a first end portion of each one of said shoulder straps is attached to the vacuum body adjacent the first one of said end faces; and a second end portion of each one of said shoulder straps is attached to the vacuum body adjacent the second one of said end faces; and wherein said battery pack is generally positioned between the first and second end portions of said shoulder straps; and further comprising a flexible hose having a first end thereof attached to the air inlet; and an extension tube attached to a second end of the extension tube, wherein the extension tube includes a plurality of segments wherein said segments are telescopingly adjustable with respect to each other.

3. A vacuum cleaner, comprising: an elongated vacuum body; a battery-pack attached to the elongated vacuum body, wherein the battery-pack is engaged with an exterior side face of the elongated vacuum body; and shoulder straps attached directly to at least one of the elongated vacuum body and the battery-pack, wherein the battery-pack is generally positioned between said shoulder straps such that the battery-pack engages a back of a person having each arm extending through a respective one of said shoulder straps.

4. The vacuum cleaner of claim 3, further comprising: battery-pack retention straps each engaged with the battery pack and extending at least partially around the vacuum body for securing the battery pack to the vacuum body.

5. The vacuum cleaner of claim 3 wherein: the vacuum body has opposing end faces and has an air outlet within a first one of said end faces and air inlet within a second one of said end faces; a first end portion of each one of said shoulder straps is attached to the vacuum body adjacent the first one of said end faces; and a second end portion of each one of said shoulder straps is attached to the vacuum body adjacent the second one of said end faces.

6. The vacuum cleaner of claim 5, further comprising: a flexible hose having a first end thereof attached to the air inlet; and an extension tube attached to a second end of the extension tube, wherein the extension tube includes a plurality of segments and wherein said segments are telescopingly adjustable with respect to each other.

7. The vacuum cleaner of claim 5 wherein the battery pack is generally positioned between the first and second end portions of said shoulder straps.

8. The vacuum cleaner of claim 7, further comprising: battery-pack retention straps each engaged with the battery pack and extending at least partially around the vacuum body for securing the battery pack to the vacuum body.

9. A vacuum cleaner, comprising: an elongated vacuum body having opposing end faces, wherein an air outlet is within a first one of said end faces and an air inlet is within a second one of said end faces; shoulder straps attached to the elongated vacuum body, wherein a first end portion of each one of said shoulder straps is attached to the vacuum body adjacent the first one of said end faces of the vacuum body and wherein a second end portion of each one of said shoulder straps is attached to the vacuum body adjacent the second one of said end faces of the vacuum body; a battery-pack attached to the elongated vacuum body; and a plurality of wheels attached to the side face of the elongated vacuum body, wherein said wheels are attached to the side face of the elongated vacuum body at a region of the side face generally opposite a region of the side face where the battery-pack is attached to the side face such that a longitudinal axis of the elongated vacuum body is located between all of said wheels and the battery pack.

10. The vacuum cleaner of claim 9, further comprising: a flexible hose having a first end thereof attached to the air inlet; and an extension tube attached to a second end of the extension tube, wherein the extension tube includes a plurality of segments and wherein said segments are telescopingly adjustable with respect to each other.

11. The vacuum cleaner of claim 9 wherein the battery-pack is engaged with an exterior side face of the vacuum body such that the battery-pack engages a back of a person having each arm extending through a respective one of said shoulder straps.

12. The vacuum cleaner of claim 9, further comprising: battery-pack retention straps each engaged with the battery pack and extending at least partially around the vacuum body for securing the battery pack to the vacuum body.

13. The vacuum cleaner of claim 11 wherein the battery pack is generally positioned between the first and second end portions of said shoulder straps.

14. The vacuum cleaner of claim 12 wherein the battery-pack is engaged with an exterior side face of the vacuum body such that the battery-pack engages a back of a person having each arm extending through a respective one of said shoulder straps.

15. The vacuum cleaner of claim 13, further comprising: battery-pack retention straps each engaged with the battery pack and extending at least partially around the vacuum body for securing the battery pack to the vacuum body.

16. The vacuum cleaner of claim 15, further comprising: a flexible hose having a first end thereof attached to the air inlet; and an extension tube attached to a second end of the extension tube, wherein the extension tube includes a plurality of segments and wherein said segments are telescopingly adjustable with respect to each other.

* * * * *